US006453141B2

(12) United States Patent
Kitoba et al.

(10) Patent No.: US 6,453,141 B2
(45) Date of Patent: Sep. 17, 2002

(54) LIQUID MATERIAL SUPPLY DEVICE THAT MAINTAINS VISCOSITY OF THE LIQUID AT A FIXED LEVEL

(75) Inventors: Utako Kitoba, Kyoto; Kosuke Sasai, Kobe, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/753,718

(22) Filed: Jan. 4, 2001

(30) Foreign Application Priority Data

Jan. 6, 2000 (JP) ..... 2000-000793

(51) Int. Cl.[7] ..... G03G 15/10
(52) U.S. Cl. ..... 399/237; 399/239
(58) Field of Search ..... 399/237, 239, 399/248

(56) References Cited

U.S. PATENT DOCUMENTS 4,299,902 A * 11/1981 Soma et al. ..... 430/125

FOREIGN PATENT DOCUMENTS

JP 55-17161 A * 2/1980
JP 10-24663 1/1998
JP 10-129102 5/1998
JP 10-235262 9/1998

* cited by examiner

*Primary Examiner*—Quana M. Grainger
(74) *Attorney, Agent, or Firm*—McDermott, Will & Emery

(57) ABSTRACT

An ink supply device that has a roller a part of which is submerged in ink and supplies ink from an ink container based on the rotation of the roller, wherein an object thereof is to prevent the solvent, the main ingredient of the ink, from evaporating and escaping from the container, and to supply ink in a stable fashion. To that end, the relationship (A/B) between the opening area A (the area of the opening 28 of the container) and the ink surface area B (the sum of the area of the ink surface other than the part thereof in which the roller is submerged and the area of the ink surface carried on the roller above the ink surface) is set to be smaller than 1 (<1) when an ink supply mode is present. When an ink non-supply mode is present, the relationship (A/B) between the opening area A (the area of the opening of the container from which the area of the part thereof taken up by the roller is subtracted) and the ink surface area B (the area of the ink surface other than the part thereof in which the roller is submerged) is set to be smaller than 1 (<1).

11 Claims, 11 Drawing Sheets

(a)

(b) liquid material supply mode (c) liquid material non-supply mode (a) liquid material supply mode (b) liquid material non-supply mode (a) liquid material supply mode (b) liquid material non-supply mode

LIQUID MATERIAL SUPPLY DEVICE THAT MAINTAINS VISCOSITY OF THE LIQUID AT A FIXED LEVEL

This application is based on application No. JP 2000-000793 filed in Japan, the contents of which is hereby incorporated by reference.

BACKGROUND OF THE INVENTION

1. Field of the Invention

The present invention pertains to an improved liquid material supply device that causes a liquid material (such as ink, for example) to be carried on the continuous outer circumferential surface (liquid material carrying surface) of a continuous carrier (such as a roller or a belt, for example), as well as to an image forming apparatus incorporating such liquid material supply device.

2. Description of the Related Art

Among various types of liquid ink supply devices are those that use a blade to cause the ink adhering to the outer circumferential surface of a rotating roller to become a thin uniform-thickness layer, and transfer this thin layer of ink to an image (comprising convex areas, or a latent image) carried on a plate, image carrier, etc.

In an ink supply device of this type, a prescribed pressure is applied to the blade such that it is in pressure contact with the outer circumferential surface of the rotating roller. The excess ink adhering to the roller is removed by the blade when the ink passes through the area of contact between the blade and the roller. As a result, a uniform thin layer of ink is formed. In addition, the thickness of the ink layer may be varied by adjusting the pressure applied to the blade that is in contact with the roller.

FIG. 11 shows a conventional ink supply device 1 using a blade as described above. This ink supply device 1 includes a container (developer container) 2. An ink cartridge 4 is located in the housing of the container 2 such that it may be removed. Ink 6 is supplied from the cartridge 4 to the container 2 such that the depth of the ink 6 is maintained at a prescribed level in the container 2. A roller (developing roller) 10, which has a shaft 8 that runs parallel to the surface of the ink 6 and extends in the direction perpendicular to the sheet, is located in the upper area of the container 2 such that the bottom of the roller is below the ink surface. The shaft 8 is connected to a motor 12, so that the roller 10 rotates in the direction of an arrow 13 in the drawing as the motor 12 rotates. A regulating blade 16, which comprises a plate-shaped elastic member supported by a pressing member 14, is located downstream from the area of the roller submerged in the ink 6 in terms of the roller rotational direction 13. This regulating blade 16 protrudes essentially tangentially to the roller 10 and in the downstream direction of the rotation of the roller 10, such that it is in contact with the roller 10 under a prescribed pressure. In addition, an image carrier (image carrying roller) 22, which has a shaft 20 that is parallel to the surface of the ink 6 and extends in the direction perpendicular to the sheet, and carries a latent image in accordance with image information, is located above and near the roller 10. The shaft 20 is connected to a motor 24, and the image carrier 22 rotates in the direction of the arrow 25 of the drawings as the motor 24 rotates.

The operation of the ink supply device 1 will be explained below with reference to FIG. 11. When the roller 10 rotates via the motor 12, the ink 6 adhering to the surface of the roller 10 reaches the regulating blade 16 as it is carried on the roller 10 as the roller 10 rotates. Here, excess ink 6 is removed by the regulating blade 16 through the receipt of a prescribed pressure therefrom. A uniform thin layer of ink 6 having a desired thickness (several $\mu$m to several tens of $\mu$m) is formed on the surface of the roller 10 in accordance with the pressure from the regulating blade. The thin layer of ink 6 is then transferred to the image carrier 22 in the transfer area 26. For the method by which to transfer the ink 6 to the image carrier 22 from the roller 10, either a contact method or a non-contact method may be used.

In the ink supply device 1 described above, where the opening 28 (the area indicated by dotted lines in the drawing) through which the interior of the container 2 is exposed to the outside atmosphere is large, the amount of solvent (i.e., water in the case of a water-based ink) of the ink 6 in the container 2 that evaporates and escapes through the opening 28 is large, and consequently, the viscosity of the ink 6 increases. If the container 2 were completely closed off, the water component of the ink 6 would be maintained in equilibrium between the ink 6 housed in the container 2 and the remaining space in the container 2, and therefore the viscosity of the ink 6 would change very little. However, in actuality, the container 2 is never completely closed during development due to the mechanical construction of the device. When the viscosity of the ink increases, an ink layer that is thicker than the desired thickness is formed on the roller 10. Such an increase in the ink layer thickness increases the amount of ink transferred to the image carrier 22, and in turn, image failure when an image is formed on the sheet using this ink (such as the so-called cockling in which the sheet warps as a result of shrinking due to absorbed ink, resulting in a wavy sheet surface, for example) as well as ink bleed-through. (In this application, 'the outside atmosphere' refers to the atmosphere that exists outside the opening 28 of the container 2, and is distinguished from the gas that exists inside the opening 28 of the container 2).

OBJECTS AND SUMMARY

The present invention was created in view of the situation described above, and the object thereof is to provide an improved ink supply device. In other words, an object of the present invention is to provide an ink supply device that can supply ink under stable conditions. More particularly, an object of the present invention is to provide an ink supply device that prevents the solvent, which is the main ingredient of the ink inside the developer container, from evaporating and escaping from the container, in order to maintain the ink viscosity at an essentially fixed level, and that consequently forms a layer of ink having an essentially uniform thickness on the surface of a liquid carrier such as a roller 10.

In order to attain this and other objects, the liquid material (ink) supply device according to one aspect of the present invention has a rotational shaft; a liquid material carrier having a continuous liquid material carrying surface around the rotational shaft; a motor that causes the liquid material carrier to rotate in a prescribed direction around the rotational shaft; and a container that houses a liquid material such that a part of the liquid material carrying surface may be submerged in the liquid material, so that the liquid material may be supplied onto the liquid material carrying surface, and the top part of which is open, wherein the liquid material supplied onto the liquid material carrying surface is conveyed to the transfer area through the rotation of the liquid material carrier that occurs based on the rotation of the motor, and is supplied to the liquid material receiving member in the transfer area. The liquid material supply device further has a liquid material supply mode in which the liquid material is supplied from the liquid material carrier to the liquid material receiving member, and a liquid material non-supply mode in which the liquid material is essentially removed from the liquid material carrier.

In this liquid material supply device, according to one aspect of the present invention, a part of the liquid material carrier is located outside the opening of the container, and the liquid material is supplied from the liquid material carrier to the liquid material receiving member using one area of the above part of the liquid material carrier, and the opening area A and the liquid material surface area B defined below satisfy the relationship (A/B)<1 when the liquid material supply mode or the liquid material non-supply mode is present.

(1) When Liquid Material Supply Mode is Present

Opening area A: The area of the opening of the container

Liquid material surface area B: The sum of the area of the liquid surface other than the part thereof in which the liquid material carrier is submerged, and the area of the liquid material surface carried on the liquid material carrier above the liquid surface.

(2) When Liquid Material Non-Supply Mode is Present

Opening area A: The area of the opening of the container from which the area of the part thereof taken up by the liquid material carrier is subtracted.

Liquid material surface area B: The area of the liquid surface other than the part thereof in which the liquid material carrier is submerged.

According to another aspect of the present invention, the liquid material carrier is located inside the container while the liquid material receiving member is located outside the container, the liquid material is supplied to the liquid material receiving member from the liquid material carrier via the opening of the container, and the opening area A and the liquid material surface area B defined below satisfy the relationship (A/B)<1 when the liquid material supply mode or liquid material non-supply mode is present.

(1) When Liquid Material Supply Mode is Present

Opening area A: The area of the opening of the container

Liquid material surface area B: The sum of the area of the liquid surface other than the part thereof in which the liquid material carrier is submerged, and the area of the liquid material surface carried on the liquid material carrier above the liquid surface.

(2) When Liquid Material Non-Supply Mode is Present

Opening area A: The area of the opening of the container

Liquid material surface area B: The area of the liquid surface other than the part thereof in which the liquid material carrier is submerged.

Furthermore, according to yet another aspect of the present invention, the liquid material carrier is located inside the container while a part of the liquid material receiving member is located inside the opening of the container, the liquid material is supplied to the liquid material receiving member from the liquid material carrier using an area of the above part of the liquid material receiving member, and the opening area A and the liquid material surface area B defined below satisfy the relationship (A/B)<0.3 when the liquid material supply mode or the liquid material non-supply mode is present.

(1) When Liquid Material Supply Mode is Present

Opening area A: The area of the opening of the container from which the area of the part thereof taken up by the liquid material receiving member is subtracted.

Liquid material surface area B: The sum of the area of the liquid surface other than the part thereof in which the liquid material carrier is submerged, and the area of the liquid material surface carried on the liquid material carrier above the liquid surface.

(2) When Liquid Material Non-Supply Mode is Present

Opening area A: The area of the opening of the container from which the area of the part thereof taken up by the liquid material receiving member is subtracted.

Liquid material surface area B: The area of the liquid surface other than the part thereof in which the liquid material carrier is submerged.

BRIEF DESCRIPTION OF THE DRAWINGS

These and other objects and features of the present invention will become apparent from the following description of preferred embodiments thereof taken in conjunction with the accompanying drawings, in which:

FIG. 2(*b*) is a basic drawing showing the state of the ink during development in the ink supply device shown in FIG. 1. FIG. 2(*c*) is a basic drawing showing the state of the ink when development is not taking place in the ink supply device shown in FIG. 1.

FIG. 4(*b*) is a basic drawing showing the state of the ink when development is not taking place in the ink supply device shown in FIG. 3.

FIG. 6(*b*) is a basic drawing showing the state of the ink when development is not taking place in the ink supply device shown in FIG. 5.

In the following description, like parts are designated by like reference numbers throughout the several drawing.

DETAILED DESCRIPTION OF THE PREFERRED EMBODIMENTS

The embodiments of the present invention are explained below with reference to the accompanying drawings. The explanation below will be provided with regard to the following three types of devices depending on the locations of the developing roller and the image carrier relative to the developer container.

Type I: A part of the developing roller is located outside the developer container (the image carrier is also located outside the developer container).

Type II: The entire developing roller is located inside the developer container, and the image carrier is located outside the developer container.

Type III: The entire developing roller is located inside the developer container, and a part of the image carrier is located inside the developer container.

Type I

Figure 1:
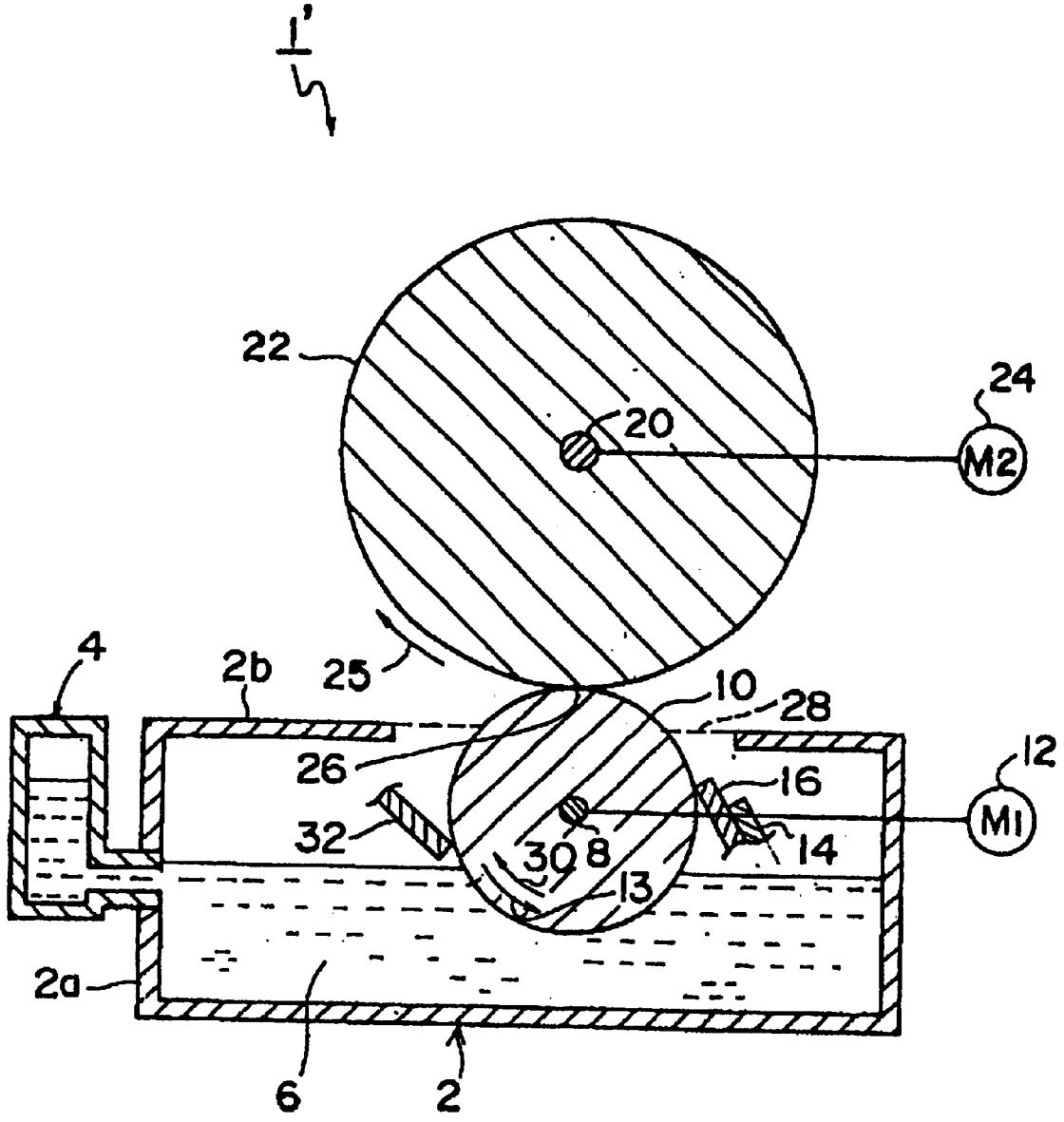
FIG. 1 is a drawing showing an ink supply device pertaining to the present invention.

FIG. 1 shows an ink supply device 1' of type I. This device resembles the ink supply device 1 shown in FIG. 11. Therefore, the same numbers are used for identical parts and members, and only the features and parts that differ from or were not explained in detail with reference to FIG. 11 will be described here.

An ink cartridge 4 is installed such that it faces the side wall 2*a* of the container 2. An opening 28 is formed in the top wall 2*b* of the container 2, and the roller 10 is located such that its top part is located above the opening 28. The roller 10 rotates with the shaft 8 working as the rotational axis, and may rotate not only in the direction of the arrow 13 but also in the reverse direction 30. The cleaning blade 32 to remove the residual ink that was not transferred in the transfer area 26 is located between the transfer area 26 and the part of the roller submerged in the ink 6 in terms of the rotational direction 13 of the roller 10, as well as near the surface of the ink 6. This cleaning blade 32 protrudes essentially tangentially to the roller 10 and in the downstream direction in terms of the rotation of the roller 10, and is in contact with the roller 10 under a prescribed pressure. Through this construction, the cleaning blade 32 removes from the outer circumferential surface of the roller 10 the ink 6 that is lifted from the container 2 with the roller 10 when the roller 10 rotates in the direction 30, which is the opposite direction from the direction of the arrow 13.

Moreover, in the present invention, in order to prevent the liquid solvent from evaporating from the ink 6 in the developer container 2 and escaping from the container 2, the opening area A that comprises the area of the region through which the gas inside the container 2 is exposed to the outside atmosphere, and the ink surface area B that comprises the area of the border surface between the ink and the gas, both of which are defined in detail below, are set such that the value of the A/B ratio is smaller than a prescribed value.

Opening Area A

Figure 2:
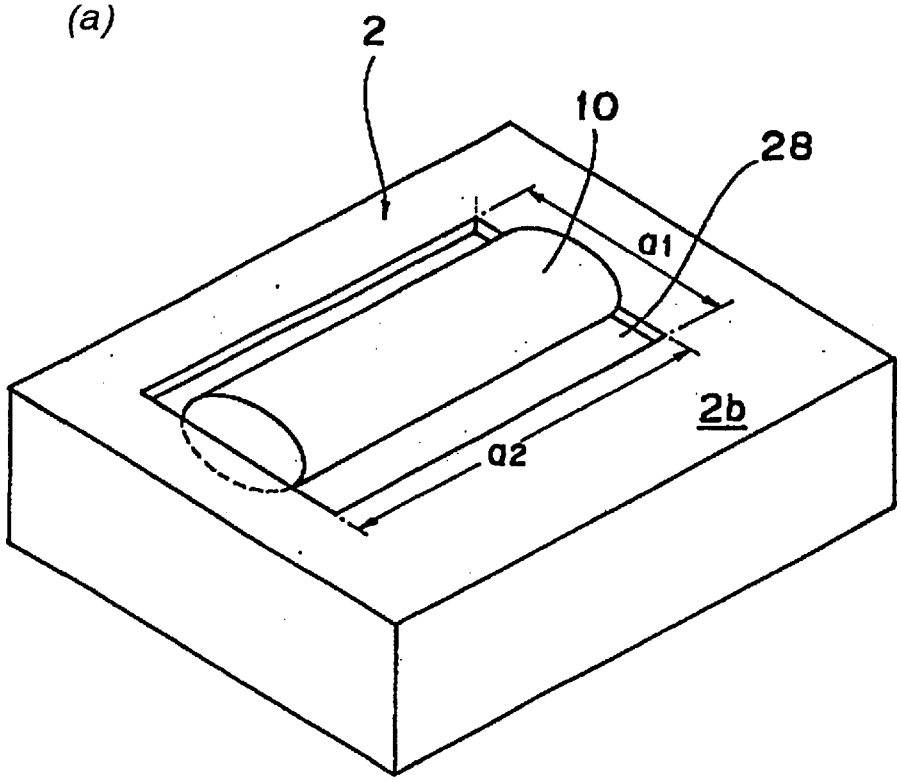
FIG. 2(*a*) is a perspective view showing the positional relationship between the developer container and the developing roller shown in FIG. 1.
Figure 2:
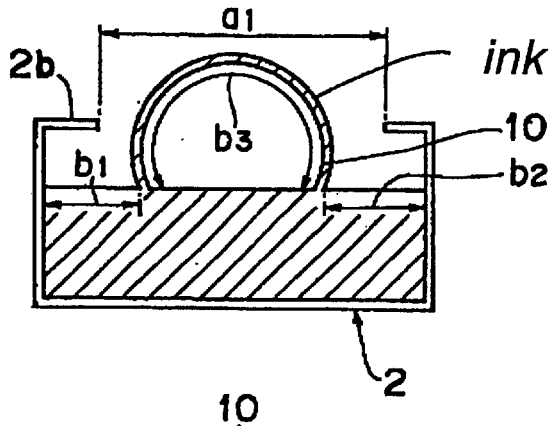
Figure 2:
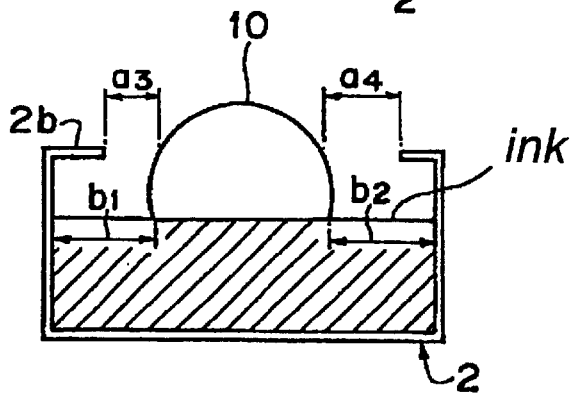

The opening area A is defined as the area of the opening 28 of the container 2 during ink supply (during development) during which an ink layer is formed on the roller 10. For example, where the opening 28 comprises a rectangle having a length and width of $a_1$ and $a_2$ as shown in FIG. 2(*a*), $A=a_1 \times a_2$.

On the other hand, during non-supply of ink or non-development during which the ink supply device 1' is not used for a prescribed period of time (as described below, there is no residual ink 6 on the roller 10), because the roller 10 has the function to close off a part of the opening 28, the opening area A is defined as the area of the opening 28 of the container 2 from which the area thereof taken up by the roller 10 is subtracted. For example, where the roller 10 is placed as shown in FIG. 2(*c*), $A=(a_3+a_4)\times a_2$.

Ink Surface Area B

Ink surface area B is defined, during development, as the total of the area C of the ink surface other than the part thereof in which the roller 10 is submerged and the area D of the ink layer surface on the roller 10 (which is above the ink surface). For example, in the case of FIG. 2(*b*), the ink surface area B is the sum of the area C corresponding to $b_1$ and $b_2$ and the area D corresponding to $b_3$.

On the other hand, when development is not taking place, i.e., when the ink supply device 1' is not used for a prescribed period of time, the ink surface area B is defined as the area C of the ink surface other than the part thereof in which the roller 10 is submerged.

Figure 11:
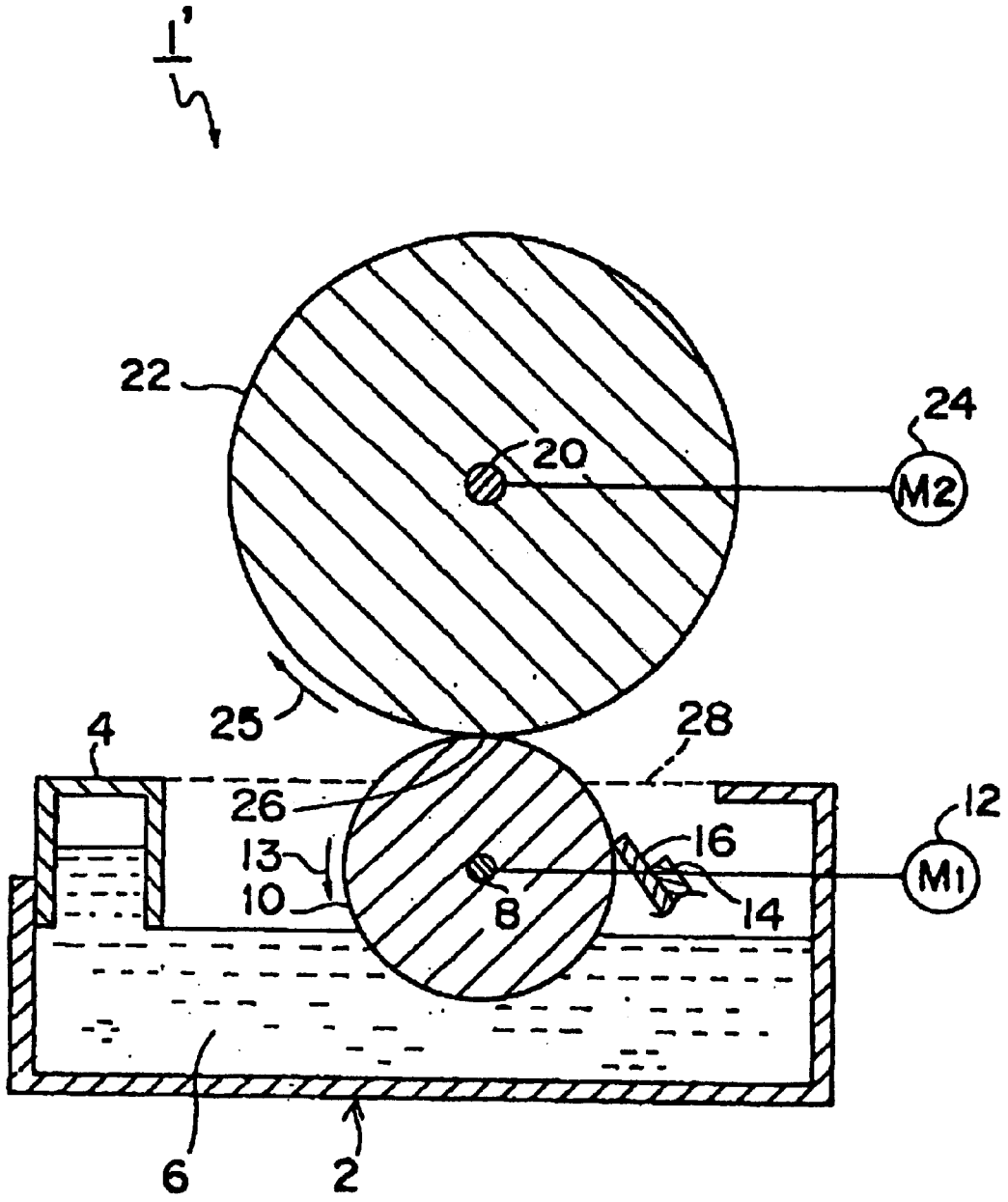
FIG. 11 is a drawing showing a conventional ink supply device.

The ink supply operation of the ink supply device 1' of this embodiment is identical to the ink supply device 1 shown in FIG. 11. Where the ink supply device 1' is not used for a prescribed period of time, the roller 10 is cleaned in the following manner after the completion of ink supply. That is, the roller 10 is rotated in the reverse direction indicated by the arrow 30 for a prescribed distance (at least until the part of the roller that is in contact with the cleaning blade 32 immediately after the commencement of the cleaning reaches the ink surface via the rotation in the direction of the arrow 30), and is thereafter stopped. In this embodiment, because the roller 10 and the cleaning blade 32 are in contact with each other close to and upstream from the ink surface in terms of the rotational direction 30 of the roller 10, in the cleaning operation, the ink 6 that adheres to the roller surface in the container 2 is removed by the cleaning blade 32 immediately after it is lifted out from the ink surface. As a result, when the ink supply device 1 is not being used, the part of the roller not submerged in the ink has no ink 6 adhering to it (see FIG. 2(*c*)).

Type II

Figure 3:
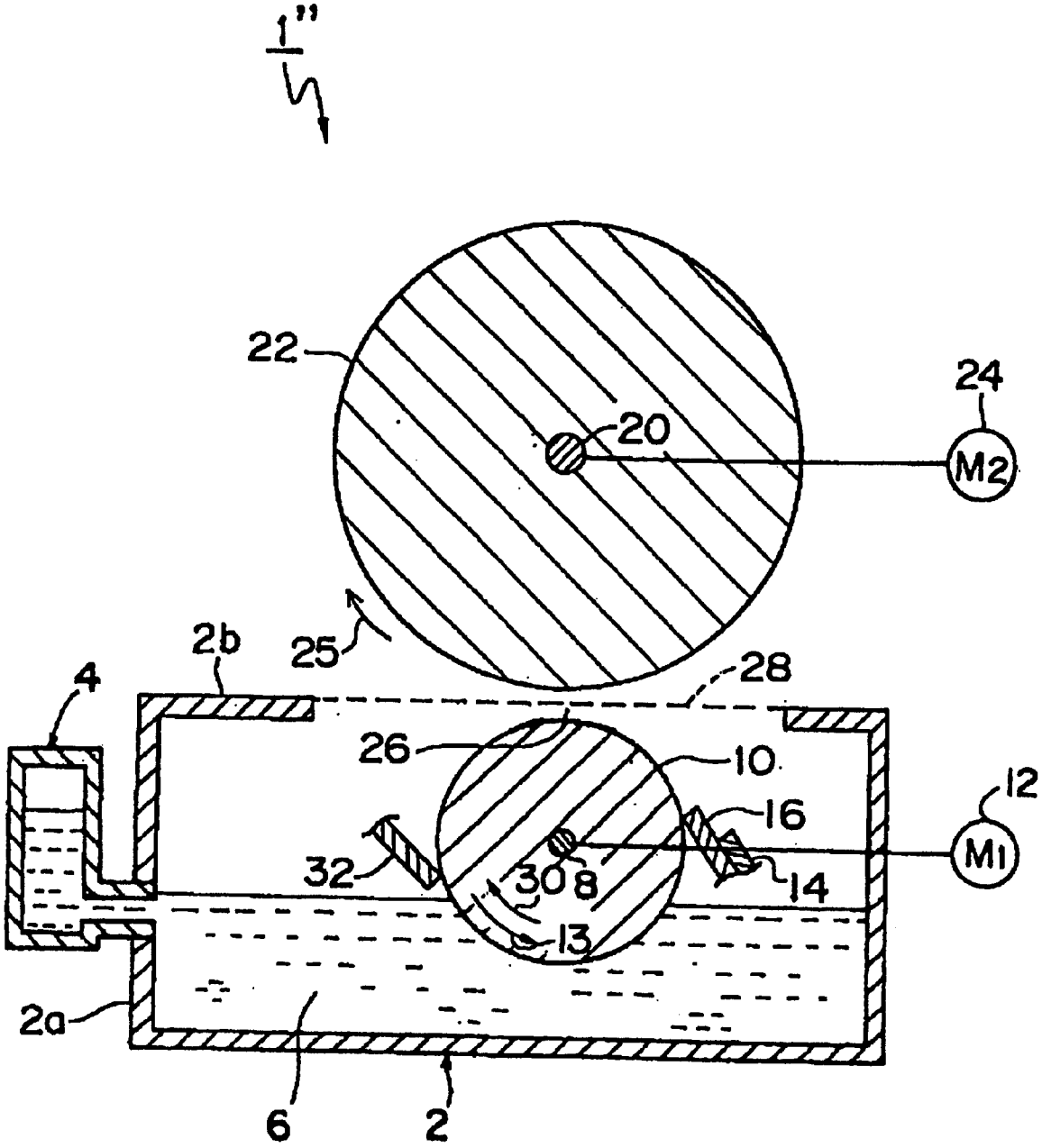
FIG. 3 is a drawing showing another ink supply device pertaining to the present invention.
Figure 4:
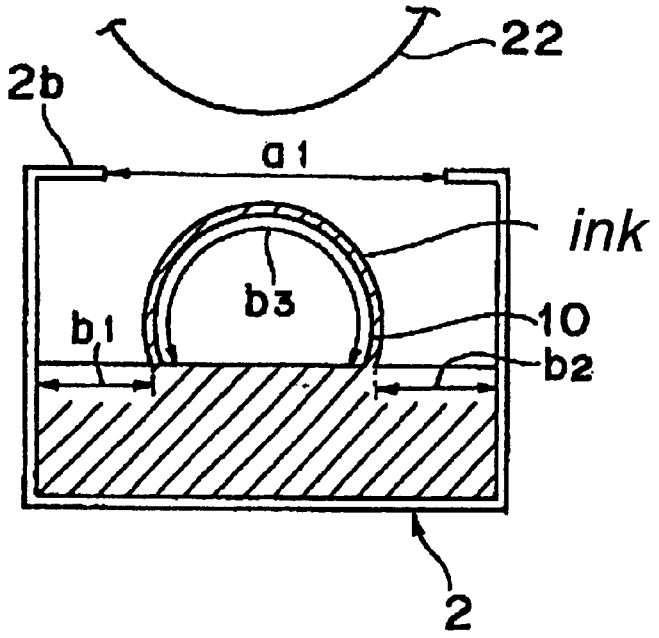
FIG. 4(*a*) is a basic drawing showing the state of the ink during development in the ink supply device shown in FIG. 3.
Figure 4:
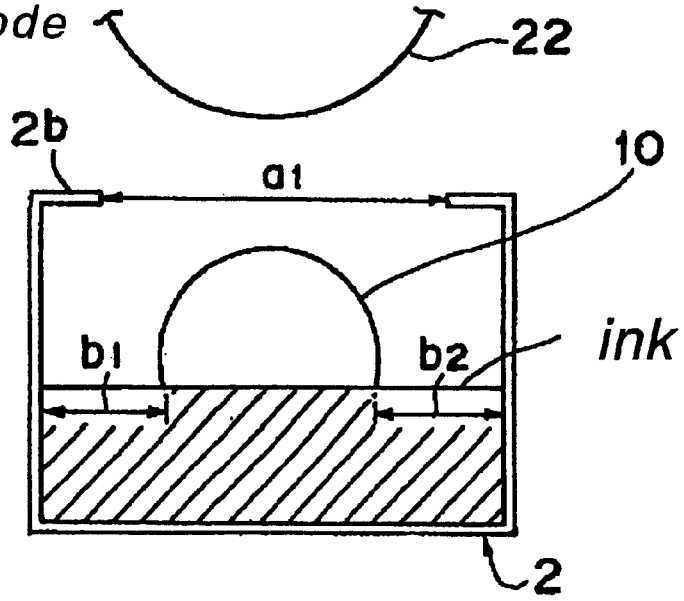

FIG. 3 shows an ink supply device 1" of type II. In this type, the entire developing roller 10 is located inside the developer container 2 while the image carrier 22 is located outside it, and therefore the opening area A is defined as the area of the opening 28 both during development and when development was not taking place. The definition of the ink surface area B is the same definition used in connection with a type I device (see FIG. 4). In the situation of a type II device, a non-contact method is used for the transfer of ink 6 from the roller 10 to the image carrier 22.

Type III

Figure 5:
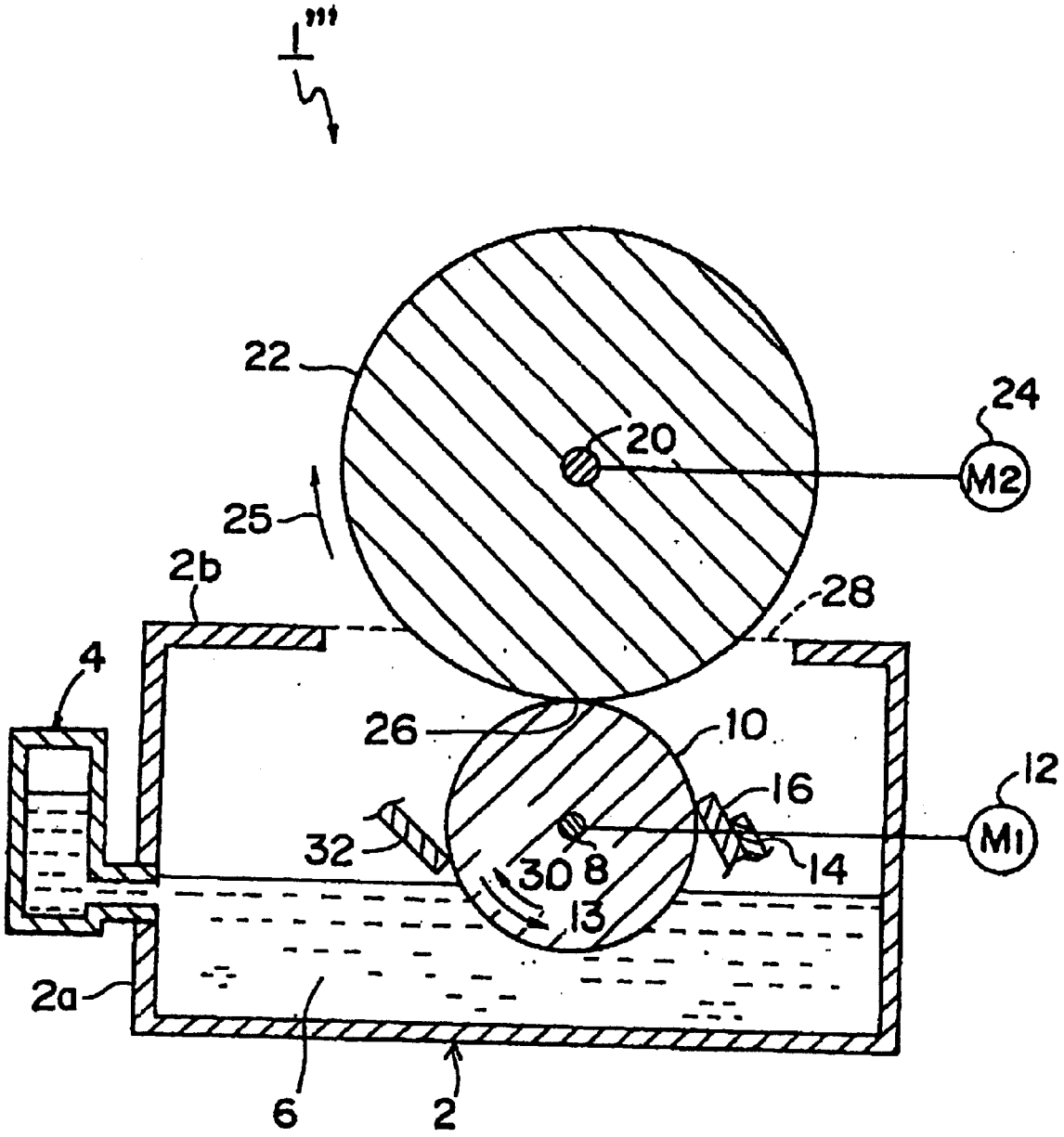
FIG. 5 is a drawing showing yet another ink supply device pertaining to the present invention.
Figure 6:
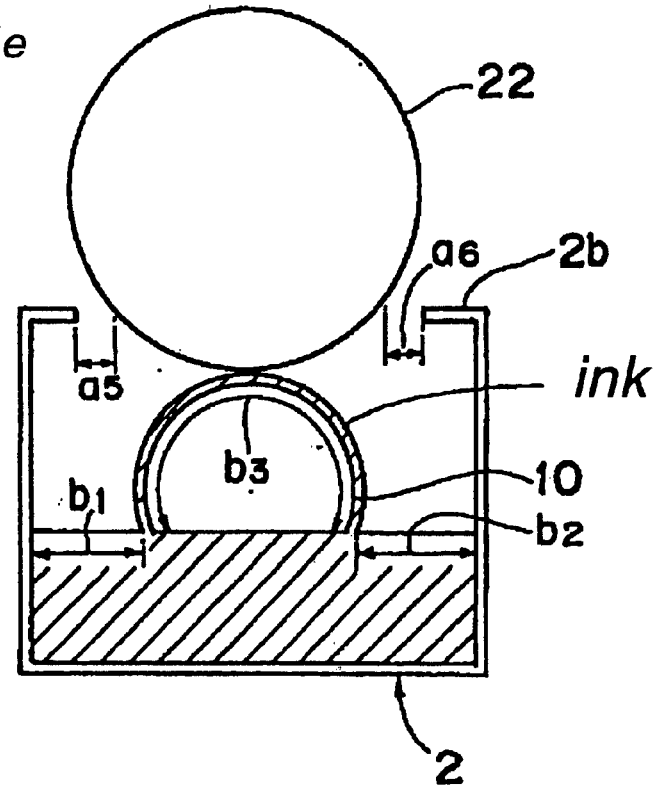
FIG. 6(*a*) is a basic drawing showing the state of the ink during development in the ink supply device shown in FIG. 5.
Figure 6:
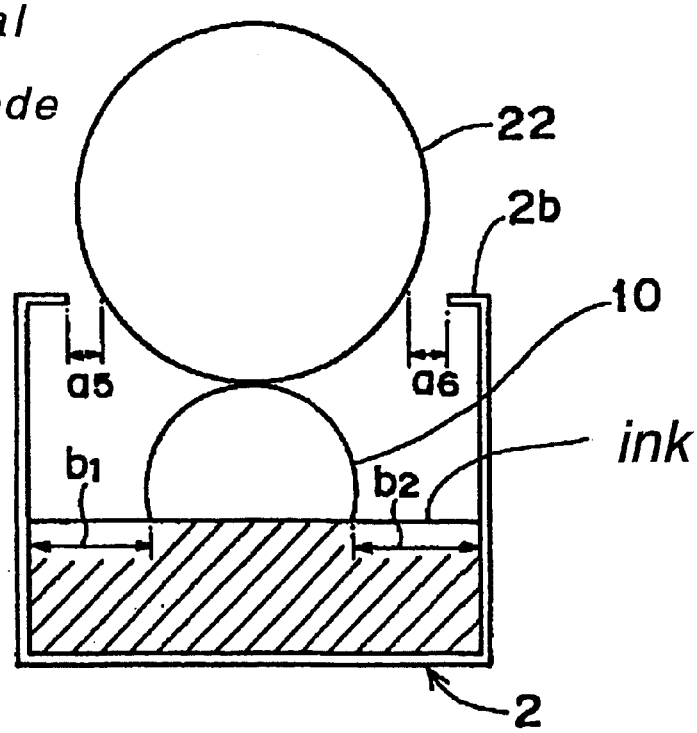

FIG. 5 shows an ink supply device 1''' of type III. In this type, the image carrier 22 closes off a part of the opening 28, and therefore the opening area A is defined as the area of the opening 28 from which the area of the part thereof taken up by the image carrier 22 is subtracted both during development and when development was not taking place. For example, where the image carrier 22 is placed as shown in FIG. 6, the opening area A comprises the areas corresponding to $a_5$ and $a_6$. The definition of the ink surface area B is the same definition used in connection with a type I device.

Experiment

Using ink supply devices of types I, II and III, the inventors of the present invention formed ink layers on the rollers using the following ink while changing the value of the opening area A/ink surface area B ratio, and measured the thickness of these thin ink layers using a Keyence LS-5000 laser-based measuring device. The ink layers were formed in ten hours after the ink was prepared and mounted in each ink supply device.

Printing Conditions

Developing roller: 3 cm diameter, 30 cm length

Image carrier (image carrying roller): 10 cm diameter, 30 cm length

Ink Composition

Distilled water: 80% by weight

Pigment: Cabot-300 (Cabot pigment dispersing agent was used), 5.0% by weight

Polyethylene glycol resin (molecular weight 20,000): 15% by weight

The mixture comprising the above ingredients was mixed and churned for 40 minutes using a stirrer, and the result was used as the ink (ink viscosity $\mu$: 30 cps).

Experiment Example 1 and Results Thereof

Ink supply device: Type I

Opening area A: 48 $cm^2$ during development, 16 $cm^2$ when development was not taking place Ink surface area B: 280 $cm^2$ during development (ink surface 75 $cm^2$, ink layer on the roller 205 $cm^2$), 75 $cm^2$ when development was not taking place (ink surface 75 $cm^2$)

Therefore, A/B=48/280=0.17 (<1) during development, A/B=16/75=0.21 (<1) when development was not taking place.

In the above experiment, while the change in ink viscosity was 20% or less and the average thickness of the ink layer was 30 $\mu$m, the unevenness of the ink layer was ±3 $\mu$m. In other words, in the above experiment, because the gas exchange between the interior of the developer container and the outside atmosphere was reduced such that the humidity inside the developer container could be maintained at a high level, the loss of the solvent (drying of the ink) could be reduced, and consequently, the change in the ink viscosity could be reduced. It was confirmed by the inventors that in order to obtain desired images with little unevenness in darkness based on an essentially uniform transfer of the ink layer on the developing roller to the image carrier, unevenness in the ink layer thickness should be kept within 20% of the average thickness. Therefore, in the above experiment example, appropriate image darkness without unevenness may be obtained. In addition, because the increase in the ink viscosity is small, bleed-through and cockling do not occur.

Experiment Example 2 and Results Thereof

Ink supply device: Type II

Opening area A: 32 $cm^2$ both during development and when development was not taking place Ink surface area B: 280 $cm^2$ during development (ink surface 75 $cm^2$, ink layer on the roller 205 $cm^2$), 75 $cm^2$ when development was not taking place (ink surface 75 $cm^2$)

Therefore, A/B=32/280=0.11 (<1) during development, A/B=32/75=0.43 (<1) when development was not taking place.

In this case as well as in the experiment example 1, gas exchange between the gas inside the developer container and the outside atmosphere was reduced and the humidity inside the developer container could be maintained at a high level, and therefore the loss of solvent (drying of the ink) could be reduced, and consequently the change in the ink viscosity could be reduced accordingly.

Comparison Example 1 and Results Thereof

Ink supply device: Type II

Opening area A: 160 $cm^2$ both during development and when development was not taking place Ink surface area B: 280 $cm^2$ during development (ink surface 75 $cm^2$, ink layer on the roller 205 $cm^2$), 75 $cm^2$ when development was not taking place (ink surface 75 $cm^2$)

Therefore, A/B=160/280=0.57 (<1) during development, A/B=160/75=2.1 (>1) when development was not taking place.

In the above comparison example, when development was not taking place (A/B>1), gas exchange between the gas inside the developer container and the outside atmosphere occurred frequently, resulting in a significant loss of ink solvent and a 20% or larger change in the ink viscosity. Consequently, when an ink layer was formed on the roller using this ink in ten hours, while the average thickness of the layer was 30 $\mu$m, the unevenness in thickness was ±8 $\mu$m. This unevenness in the ink layer thickness appears as an unevenness in the ink amount transferred to the image carrier and further as an unevenness in the image formed by this ink. In addition, because the ink viscosity increased, bleed-through and cockling occurred.

Summary of Type I and Type II Experiment Results

With type I and type II configurations in which the image carrier is located outside the developer container, when the opening area A/ink surface area B ratio is smaller than 1, the change in the ink viscosity following a prescribed non-use period may be kept within a desired range, and as a result, an ink layer having a desired thickness may be stably formed on the developing roller. The preferred range for the A/B ratio is shown in the following table.

| A/B | Image quality |
|---|---|
| 0.5 or less | Very good image without unevenness |
| 0.5–1.0 | Good image |
| 1.0 or more | Image unevenness occurs |

Experiment Example 3 and Results Thereof

Ink supply device: Type III

Opening area A: 16 $cm^2$ both during development and when development was not taking place Ink surface area B: 280 $cm^2$ during development (ink surface 75 $cm^2$, ink layer on the roller 205 $cm^2$), 75 $cm^2$ when development was not taking place (ink surface 75 $cm^2$)

Therefore, A/B=16/280=0.057 (<0.3) during development, A/B=16/75=0.21 (<0.3) when development was not taking place.

In the above experiment, while the change in ink viscosity was 20% or less and the average thickness of the ink layer was 30 $\mu$m, the unevenness of the ink layer was ±3 $\mu$m. In other words, because gas exchange between the gas inside the developer container and the outside atmosphere was reduced such that the humidity inside the developer container could be maintained at a high level, and the solvent of the ink inside the developer container (particularly, the ink on the developing roller) could be reduced, a change in ink viscosity in the developer container could be reduced accordingly.

In addition, in this experiment example, the surface of the image carrier inside the opening of the developer container is maintained in the high-humidity gas inside the developer container, and therefore, the drying of the developing ink adhering to the image carrier may also be reduced. As a result, a film of dried ink does not form on the image carrier surface and the viscosity of the ink transferred to the image carrier does not change due to the dried ink. Therefore, the ink layer on the image carrier is also formed in a stable manner, and appropriate image darkness without unevenness may be obtained.

Comparison Example 2 and Results Thereof

Ink supply device: Type III

Opening area A: 62 $cm^2$ both during development and when development was not taking place Ink surface area B: 280 $cm^2$ during development (ink surface 75 $cm^2$, ink layer on the roller 205 $cm^2$), 75 $cm^2$ when development was not taking place (ink surface 75 $cm^2$)

Therefore, A/B=62/280=0.22 (<0.3) during development, A/B=62/75=0.83 (>0.3) when development was not taking place.

In the above comparison example, when development was not taking place (A/B>0.3), dried ink film was formed on the image carrier and the viscosity of the ink transferred to the image carrier changed due to this dried ink, and during development ten hours later, there was insufficient fusing of the ink from the image carrier to the sheet, resulting in image failure such as blurriness.

Summary of Type III Experiment Results

With a type III configuration in which a part of the image carrier was located inside the developer container, when the opening area A/ink surface area B ratio was smaller than 0.3, the formation of ink film on the image carrier was prevented, and therefore desired images could be obtained. The preferred range for the A/B ratio is shown in the following table.

| A/B | Image quality |
|---|---|
| 0.2 or less | Quite good image |
| 0.2–0.3 | Good image |
| 0.3 or more | Image failure such as blurriness occurs |

While ink supply devices pertaining to the present invention were explained above, the present invention may be modified in various ways. For example, while a roller 10 and image carrier 22 were used as the members to form an ink layer and the member to form an image, respectively, any other members (belt-shaped or flat members, for example) may be used so long as the construction is such that the regulating blade 16 or the cleaning blade 32 forms an ink layer on the member or removes the residual ink that was not transferred while it is in contact with the member surface and moves relative to the member. Examples of flat members include flat plates having a certain thickness and rigidity, such as printing plates, or film (such as plastic film, for example) wrapped around a drum and cut into a sheet-shaped piece for each printing. In the case of the latter, an ink layer is formed on the sheet-shaped piece which is wrapped on an image carrier or placed on a flat plate.

In addition, the opening 28 of the developer container 2 is not limited to the rectangular shape shown in FIG. 2(*a*), and may have any other shape.

Furthermore, the cleaning blade may be placed between the part of the roller submerged in the ink 6 and the regulating blade 16 in terms of the rotational direction 13 of the roller 10 and near the surface of the ink 6, such that it may move between a position separate from the roller 10 and a position at which it is in contact with the roller 10 and eliminates the ink 6 on the roller 10. Where the ink supply device is not used for a prescribed period of time, cleaning is performed for a prescribed period of time (the time until at least the part of the roller that is in contact with the cleaning blade immediately after the commencement of cleaning re-enters the ink due to the rotation in the direction of the arrow 13) after the cleaning blade 32 moves to the contact position and starts cleaning after the completion of ink supply, and the roller 10 is then stopped. As a result, after the roller is stopped, no ink 6 remains on the outer circumferential surface of the roller above the ink surface.

First Embodiment of Image Forming Apparatus

Figure 7:
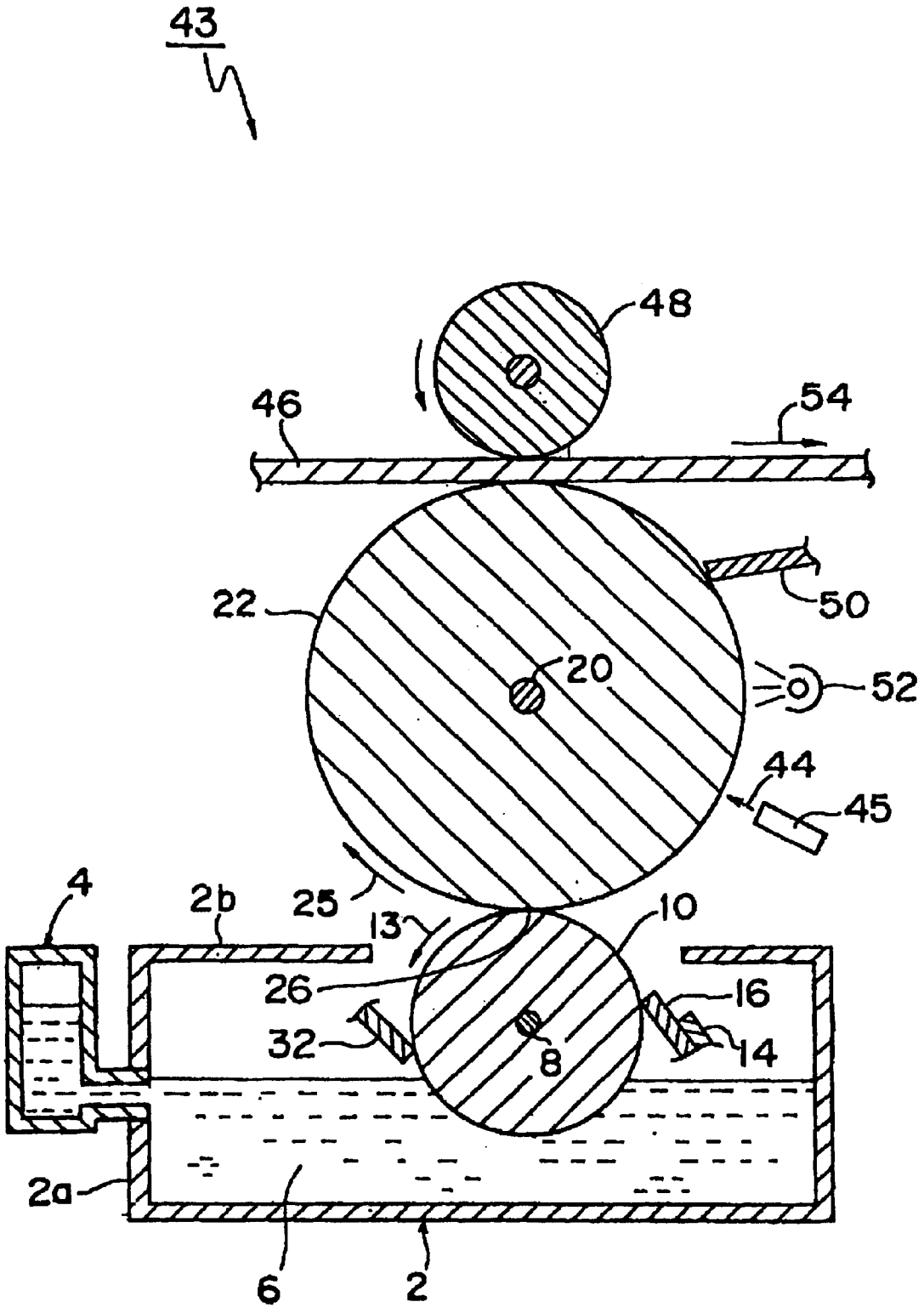
FIG. 7 is a drawing showing a first embodiment of the image forming apparatus using an ink supply device pertaining to the present invention.

FIG. 7 shows an example in which the ink supply device 1' pertaining to the present invention is applied in an image forming apparatus 43 that uses a wet latent image. The image carrier 22 comprises a base, a photoisomerization layer (a layer that can reversibly change from hydrophilic to hydrophobic when irradiated with light, i.e., a layer having a material which reversibly changes the wettability of the image carrier) formed on the outer circumference of the base, and an overcoat layer formed on the outer circumference of the above layer for protection. Around the image carrier 22 is located an exposure device 45, which is positioned upstream from the roller (developer roller) 10 in terms of the rotational direction 25 of the image carrier 22, and which selectively irradiates the image carrier 22 with ultraviolet light 44 in accordance with image information and thereby forms a latent image on the image carrier 22 (the photoisomerization layer). Furthermore, downstream from the developer roller 10 in terms of the rotational direction 25 of the image carrier 22 are located, in the following order, a transfer roller 48 that transfers to the recording medium 46 the ink 6 that adhered to the image carrier 22 in the contact area 26 between the image carrier 22 and the developer roller 10, a cleaning device (such as a cleaning blade, for example) 50 that removes the ink 6 remaining on the image carrier 22 after transfer, and a latent image eliminating device (such as an eraser lamp, for example) 52 that eliminates the latent image on the image carrier 22 by irradiating the image carrier 22 with visible light (erasing light) after transfer.

The transfer roller 48 also conveys the recording medium 46 in the direction of the arrow 54 by rotating in the direction of the arrow while holding the recording medium 46, which has been supplied from a paper tray not shown in the drawing, between itself and the image carrier 22. The recording medium 46 and the ink 6 adhering thereto are conveyed to a fusing means not shown in the drawing, through which the ink is dried and fused onto the recording medium 46, and the recording medium 46 is then ejected onto an eject tray not shown in the drawing. The fusing means may be omitted if the ink 6 adheres sufficiently to the recording medium 46.

The image forming operation of the image forming apparatus 43 having the above construction will now be explained. First, based on image information, the exposure device 45 selectively irradiates the image carrier 22 that is being rotated in the direction of the arrow 25 with light 44. As a result, a latent image is formed on the image carrier 22 (the latent image areas are hydrophilic, while the other areas are hydrophobic). Subsequently, ink 6 selectively adheres to the latent image in the contact area 26 between the image carrier 22 and the developing roller 10, whereupon an ink image is formed. This ink image moves to the area at which the image carrier 22 faces the transfer roller 48 as the image carrier 22 rotates, and is transferred onto the recording medium 46.

The residual ink 6 that was not transferred to the recording medium 46 in the area at which the image carrier 22 faces the transfer roller 48 is removed by the cleaning device 50. The latent image areas on the photoisomerization layer of the image carrier 22 are erased by the erasing light irradiated from the latent image eliminating device 52 (i.e., the entire photoisomerization layer returns to being hydrophobic).

Second Embodiment of Image Forming Apparatus

Figure 8:
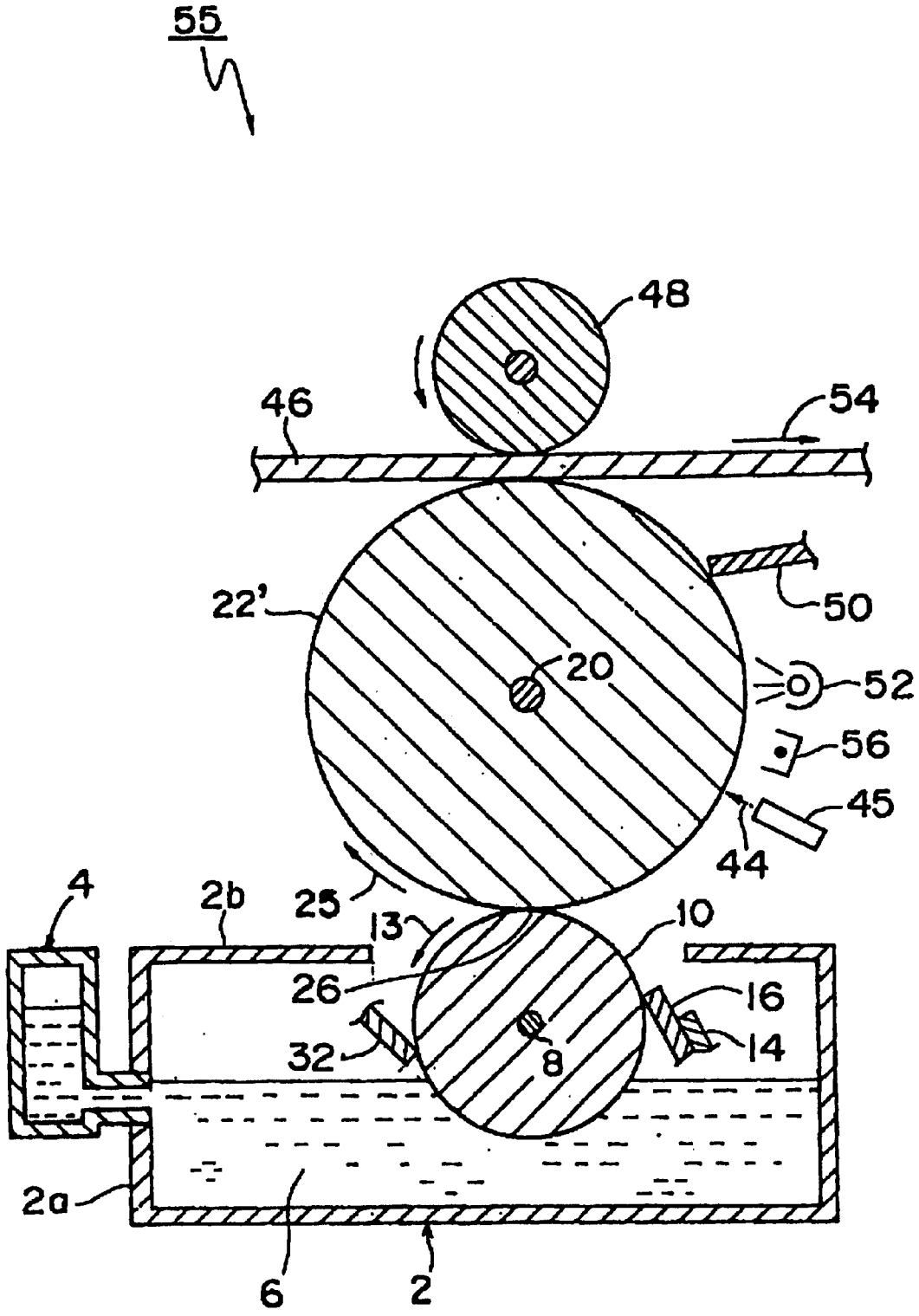
FIG. 8 is a drawing showing a second embodiment of the image forming apparatus using an ink supply device pertaining to the present invention.

FIG. 8 shows an example in which the ink supply device 1' pertaining to the present invention is applied in an image forming apparatus 55 that uses a static latent image. This image forming apparatus 55 is very similar to the above image forming apparatus 43, and only the differences will be explained below. The image carrier 22' of the image forming apparatus 55 is a photoconductive drum comprising a base, a charge generating layer and a charge transporting layer formed on the outer circumference of the base, and an overcoat layer (such as a 1–2 μm insulating film, for example) formed on the outer circumference of the charge generating and transporting layers in order to protect the lower layers and the escape of the latent image charge. Between the latent image eliminating device 52 and the exposure device 45 in terms of the rotational direction 25 of the image carrier 22' is located a corona charger device 56 to uniformly charge the surface of the image carrier 22'.

The image forming operation of the image forming apparatus 55 having the above construction will now be explained. First, discharge by the corona charger device 56 is carried toward the image carrier 22', which is being rotated in the direction of the arrow 25, in order to charge the surface of the image carrier 22'. Light 44 is then selectively irradiated from the exposure device 45 based on image information. As a result, a latent image is formed on the image carrier 22'. Ink 6 then selectively adheres to the latent image areas in the contact area 26 between the image carrier 22' and the developing roller 10, whereupon an ink image is formed. This ink image moves to the area at which the image carrier 22' faces the transfer roller 48 as the image carrier 22' rotates, and is transferred onto the recording medium 46.

The residual ink 6 that was not transferred to the recording medium 46 in the area at which the image carrier 22' faces the transfer roller 48 is removed by the cleaning device 50. The latent image areas of the image carrier 22' are erased by the erasing light irradiated from the latent image eliminating device 52.

Third Embodiment of Image Forming Apparatus

Figure 9:
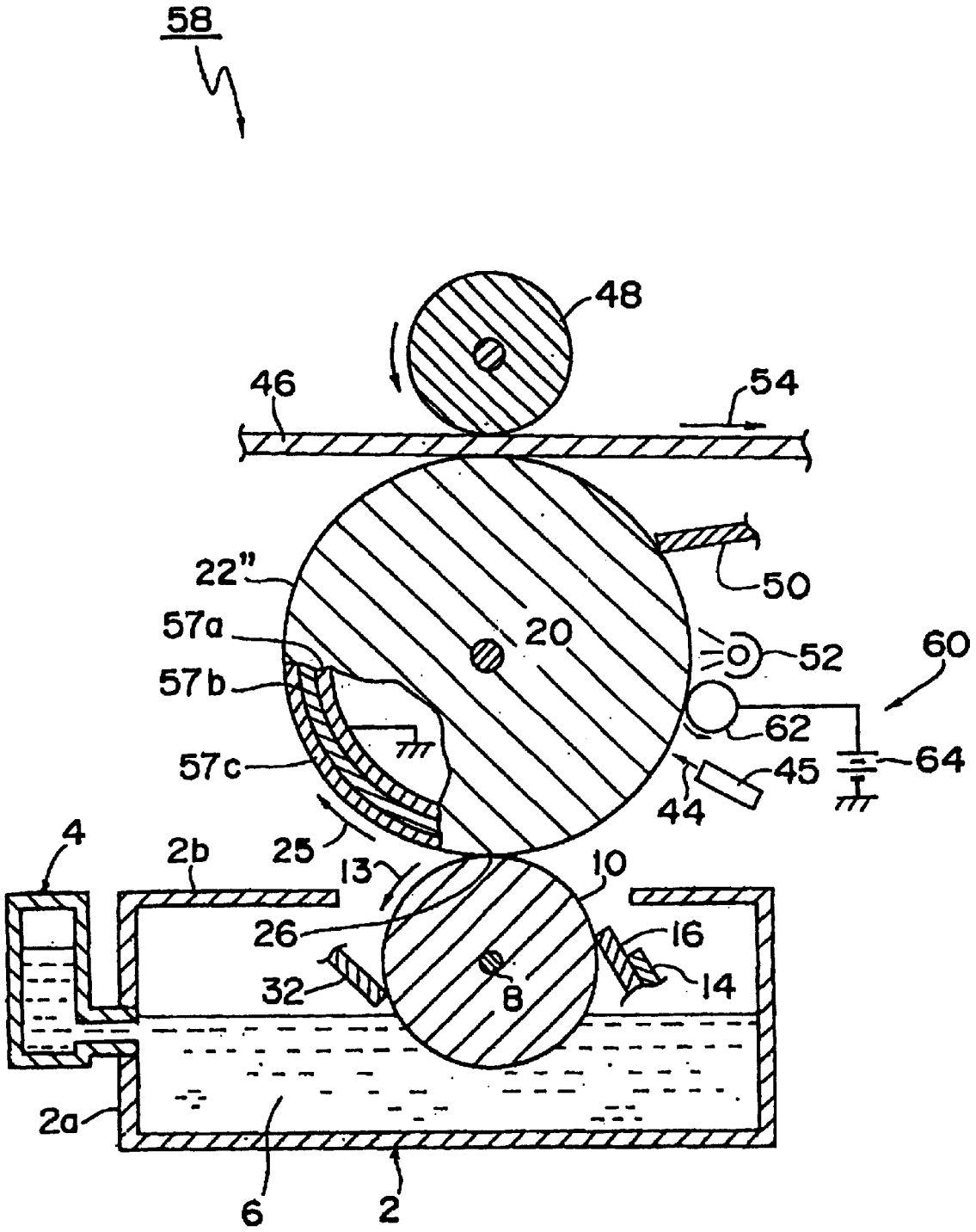
FIG. 9 is a drawing showing a third embodiment of the image forming apparatus using an ink supply device pertaining to the present invention.

FIG. 9 shows an example in which the ink supply device 1' pertaining to the present invention is applied in another image forming apparatus 58 that uses a static latent image. This image forming apparatus 58 is very similar to the above image forming apparatus 43, and only the differences will be explained below. The image carrier 22" comprises a roller-shaped or cylindrical (cylindrical in the drawing) base 57*a* made of metal such as aluminum, a ferroelectric layer 57*b* (such as PLZT, for example) formed on the outer circumference of the base, and an overcoat layer 57*c* (made of a fluoride material (PVDF/TeEF), for example) formed on the outer circumference of the ferroelectric layer. Between the latent image eliminating device 52 and the exposure device 45 in terms of the rotational direction 25 of the image carrier 22" is located a voltage applying device 60 that uniformly polarizes the ferroelectric layer 57*b* of the image carrier 22" (this process is called polling hereinbelow). In this embodiment, a heat lamp that eliminates the latent image in the ferroelectric layer 57*b* through heating is used as the latent image eliminating device 52.

The voltage applying device 60 has a conductive roller 62 that rotates in the direction of the arrow as the image carrier 22" rotates while being in contact with the image carrier 22", and a bias power supply 64. The bias power supply 64 applies a prescribed bias voltage (a voltage having a positive polarity in this embodiment) to the image carrier 22" via the conductive roller 62. Although the base 57*a* of the image carrier 22" is grounded here, a bias voltage may be applied under other conditions as well. When a bias voltage is applied, the difference between the voltage from the bias power supply 64 and the voltage applied to the base 57*a* is applied to the ferroelectric layer 57*b* of the image carrier 22".

Figure 10:
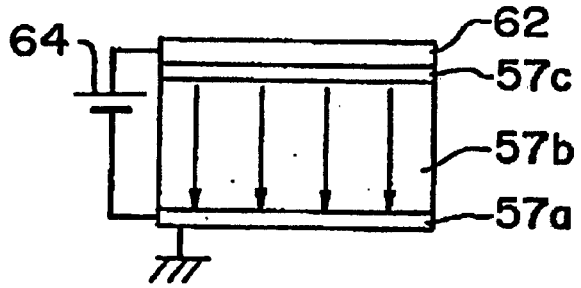
FIGS. 10(A) through 10(F) are a process drawing showing the method of image formation by the image forming apparatus shown in FIG. 9.
Figure 10:
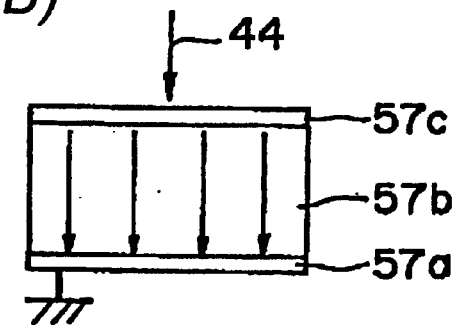
Figure 10:
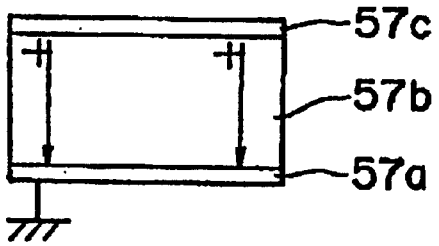
Figure 10:
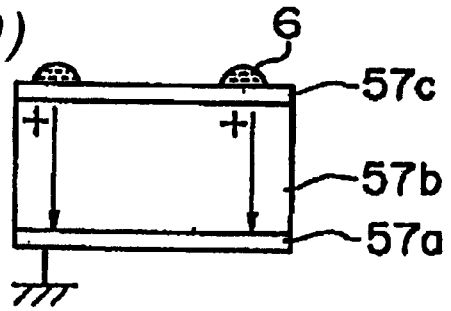
Figure 10:
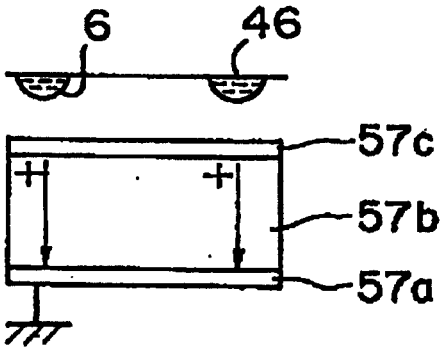
Figure 10:
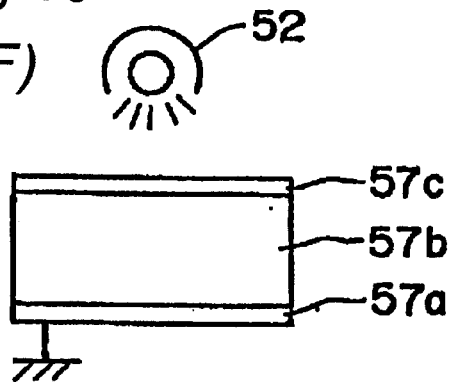

The image forming operation of the image forming apparatus 58 having the above construction will now be explained with reference to FIGS. 9 and 10. Polling of the ferroelectric layer 57*b* of the image carrier 22" that is being rotated in the direction of the arrow 25 is first performed via the voltage applying device 60 (FIG. 10(A)). (In FIG. 10, the arrows in the ferroelectric layer 57*b* indicate that polarization is taking place in the areas corresponding to these arrows.) Subsequently, based on image information, the exposure device 45 selectively irradiates the ferroelectric layer 57*b* with light 44 (FIG. 10(B)). The latent image areas irradiated by the light are heated beyond the Curie point and the polarization thereof is cancelled out (FIG. 10(C)). In the transfer area 26, ink 6 selectively adheres to the latent image areas (having a positive polarity) from which polarization was not eliminated, due to the gravitational force between the latent image and the oxygen atoms of the water molecules, whereupon an ink image is formed (FIG. 10(D)). This ink image moves to the area at which the image carrier 22" faces the transfer roller 48 as the image carrier 22" rotates, and is transferred onto the recording medium 46 (FIG. 10(E)).

The residual ink 6 that was not transferred onto the recording medium 46 in the area at which the image carrier 22" faces the transfer roller 48 is eliminated by the cleaning device 50. The latent image area in the ferroelectric layer 57*b* of the image carrier 22" is heated beyond the Curie point by the latent image eliminating device 52, and the polarization thereof is eliminated (FIG. 10(F)).

As is well known to vendors knowledgeable in the art, various methods are available other than that used in the above embodiment in order to form a latent image in the ferroelectric layer. One example would be the method in which a voltage is applied to the ferroelectric layer after polling so that a latent image may be formed by reversing the polarization in some areas of the above layer.

As the ferroelectric material used in the ferroelectric layer 57*b*, either inorganic or organic materials may be used. Specifically, such inorganic materials as PLZT, $SrBi_2Ta_2O_9$, PZT, $BaTiO_3$, $LiNbO_3$, $PbTiO_3$, $KNbO_3$, $KTaO_3$, $PbNb_2O_6$, $SrTiO_3$, $LiTaO_3$, $Sr_{1-x}Ba_xNb_2O_6$, $Pb_{1-x}La_xNb_2O_6$, and $BiNaTiO_6$, and such organic materials as co-polymer of vinylidene fluoride and tetrafluoroethylene, vinylidene polycyanade, co-polymer of vinylidene cyanade and vinyl acetate, polyvinylidene fluoride, and co-polymer of vinylidene fluoride and trifluoroethylene, may be used. It is also acceptable if a composite material comprising both an inorganic ferroelectric material and an organic ferroelectric material is used.

The overcoat layer 57*c* is used to control the durability and the ink wettability of the image carrier 22". For the material thereof, a material is preferred that has a desired insulating property that will increase the ability of the ferroelectric layer 57*b* to maintain polarization, as well as a high surface tension that brings about high ink wettability and friction resistance. For example, resins having these properties include epoxy resin, polyurethane resin, polyamide resin and polycarbonate resin, ceramics having these properties include $Al_2O_3$, SiC, and $BaTiO_3$, and glass substances having these properties include element glass, hydrogen bond glass, chloride glass and fluoride glass.

The above ink supply devices and image forming apparatuses pertaining to the present invention may be used as the image forming unit in a copying machine (such as the Minolta EP-6000, for example) and/or a printer (such as Minolta ColorPagePro L, for example) that uses the electrophotographic method.

Using an ink supply device pertaining to the present invention, because gas exchange between the gas inside the developer container and the outside atmosphere is reduced, drying of the ink (i.e., loss of the liquid solvent) may be reduced. As a result, the thickness of the ink layer formed on the roller surface via the regulating blade, as well as the amount of ink transferred to the image carrier, become essentially uniform, so that high quality images that do not include unevenness in darkness or image failure may be obtained, and bleed-through may be prevented.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. A liquid supply device comprising:

a container, the top part of which is open, for accommodating liquid therein; and a carrier arranged in the container so that a part of said carrier is submerged in the liquid accommodated in said container, said carrier having a continuous surface around a rotational axis and conveying the liquid to the open top part of the container by rotating around the rotational axis, wherein a part of said carrier is located outside the opening of the container, and wherein the following conditions are satisfied:

$$A/(B+C)<1$$

$$D/B<1$$

where

A is the area of the opening of the container,

B is the area of the liquid surface other than the part thereof in which the carrier is submerged, C is the area of the carrier surface above the liquid surface, and D is the area of the opening of the container from which the area of the part thereof taken up by the carrier is subtracted.

2. A liquid supply device as claimed in claim 1, further comprising:

a receiver for receiving the liquid from the carrier, wherein the liquid is supplied from the carrier to the receiver using one area of the above part of the carrier.

3. A liquid supply device as claimed in claim 1, further comprising:

a regulator for forming a uniform thin layer of liquid on the surface of the carrier, said regulator is located downstream from the part of the carrier submerged in the liquid in terms of the carrier rotational direction and is in contact with the carrier under a prescribed pressure.

4. A liquid supply device as claimed in claim 1, wherein said liquid supply device is used in an image forming apparatus.

5. A liquid supply device comprising:

a container, the top part of which is open, for accommodating liquid therein; and a carrier arranged in the container so that a part of said carrier is submerged in the liquid accommodated in said container, said carrier having a continuous surface around a rotational axis and conveying the liquid to the open top part of the container by rotating around the rotational axis, wherein said carrier is located inside the container, and wherein the following condition is satisfied:

$$A/B<1$$

where

A is the area of the opening of the container, and

B is the area of the liquid surface other than the part thereof in which the carrier is submerged.

6. A liquid supply device as claimed in claim 5, further comprising:

a receiver for receiving the liquid from the carrier, wherein the receiver is located outside the container and the liquid material is supplied to the receiver from the carrier via the opening of the container.

7. A liquid supply device as claimed in claim 5, further comprising:

a regulator for forming a uniform thin layer of liquid on the surface of the carrier, said regulator is located downstream from the part of the carrier submerged in the liquid in terms of the carrier rotational direction and is in contact with the carrier under a prescribed pressure.

8. A liquid supply device as claimed in claim 5, wherein said liquid supply device is used in an image forming apparatus.

9. A liquid supply device comprising:

a container, the top part of which is open, for accommodating liquid therein;

a carrier arranged in the container so that a part of said carrier is submerged in the liquid accommodated in said container, said carrier having a continuous surface around a rotational axis and conveying the liquid to the open top part of the container by rotating around the rotational axis; and a receiver for receiving the liquid from the carrier, wherein the carrier is located inside the container while a part of the receiver is located inside the opening of the container, the liquid is supplied to the receiver from the carrier using an area of the above part of the receiver, and wherein the following condition is satisfied:

$$D/B<0.3$$

where

D is the area of the opening of the container from which the area of the part thereof taken up by the receiver is subtracted, and B is the area of the liquid surface other than the part thereof in which the carrier is submerged.

10. A liquid supply device as claimed in claim 9, further comprising:

a regulator for forming a uniform thin layer of liquid on the surface of the carrier, said regulator is located downstream from the part of the carrier submerged in the liquid in terms of the carrier rotational direction and is in contact with the carrier under a prescribed pressure.

11. A liquid supply device as claimed in claim 9, wherein said liquid supply device is used in an image forming apparatus.

* * * * *